United States Patent [19]

Linke et al.

[11] Patent Number: 4,873,792

[45] Date of Patent: Oct. 17, 1989

[54] POLISHING APPARATUS

[75] Inventors: Thomas A. Linke, Wadsworth; Issa R. Dandan, Niles; Troy W. Livingston, Northbrook, all of Ill.; Alan W. Wilkerson, Cedarburg, Wis.

[73] Assignee: Buehler, Ltd., Lake Bluff, Ill.

[21] Appl. No.: 200,842

[22] Filed: Jun. 1, 1988

[51] Int. Cl.[4] ..... B24B 49/04

[52] U.S. Cl. ..... 51/165.8; 51/165.77; 51/131.4

[58] Field of Search ..... 51/131.4, 131.3, 131.1, 51/129, 165.8, 165.77, 165.9, 34 E, 34 H, 77 R, 79; 408/137

[56] References Cited

U.S. PATENT DOCUMENTS 4,449,871 5/1984 Hillestad ..... 408/137

4,771,578 9/1988 Jorgensen et al. ..... 51/129

*Primary Examiner*—Robert P. Olszewski

*Assistant Examiner*—Maurina Rachuba

*Attorney, Agent, or Firm*—Allegretti & Witcoff, Ltd.

[57] ABSTRACT

Apparatus for polishing or grinding specimens in which the pressure between the sample and the platen against which it presses for grinding or polishing is controlled by a feedback system, which includes a strain gauge from which the sample-holding grinding shaft is suspended.

21 Claims, 2 Drawing Sheets

FIG. 1
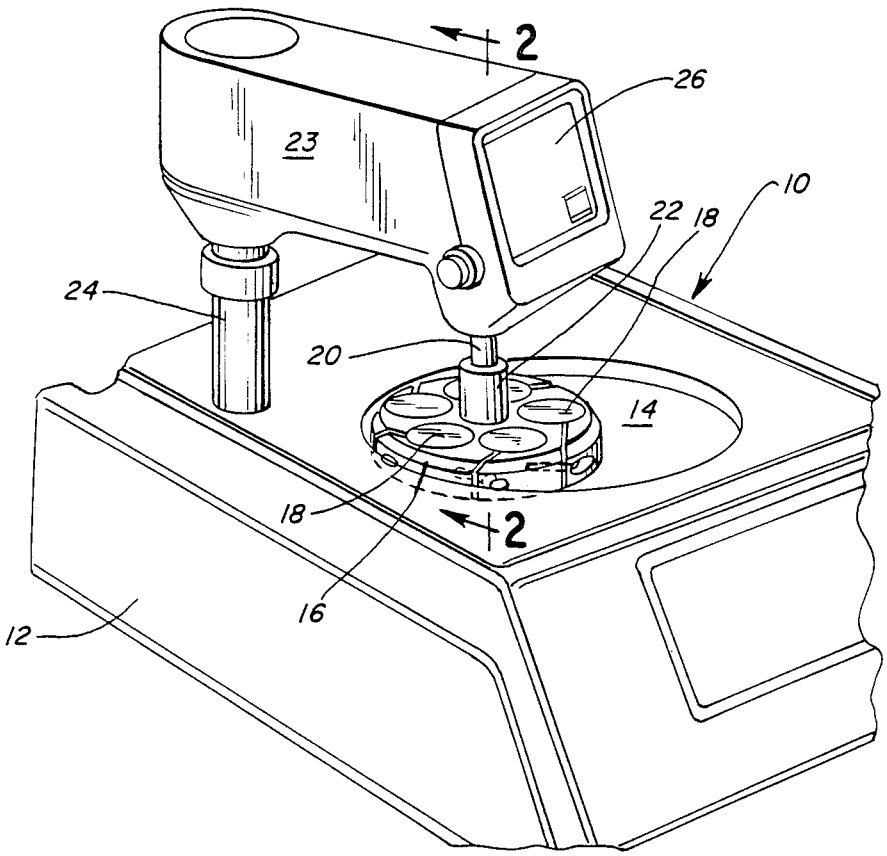
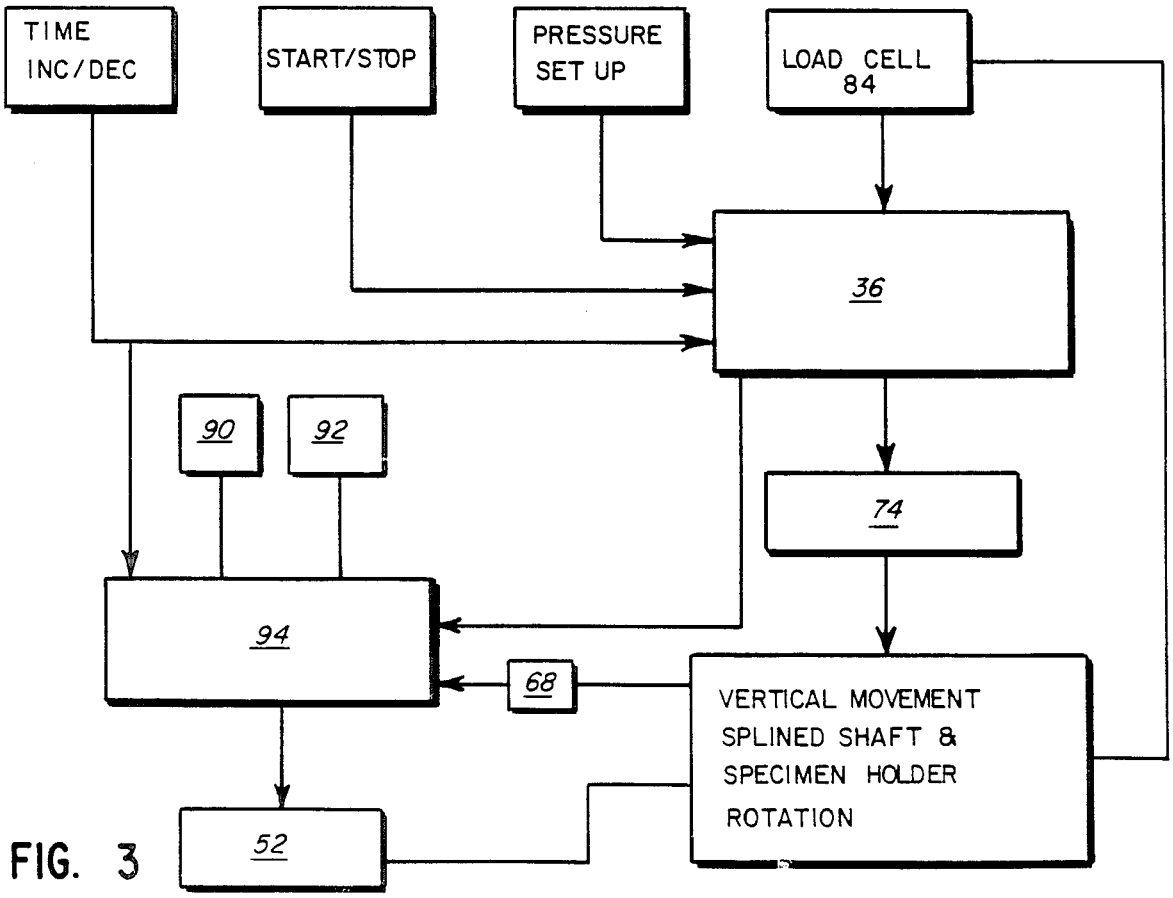
FIG. 3

POLISHING APPARATUS

BACKGROUND OF THE INVENTION

Polishing or grinding apparatus which utilize a rotating turntable or platen are of course well known to the art. Furthermore, polishing apparatus are presently commercially available in which holders for samples to be polished are pressed down at a predetermined pressure on a rotating turntable. These holders typically rotate themselves during operation, to provide an automatic, complex motion polishing process for samples.

In the field of microstructural analysis, such automatic polishing or grinding machines are available. For example, the Euromet (T.M.) polishing/grinding apparatus has been sold by Buehler Ltd. of Lake Bluff, Ill. This device is a power head which is pressed against a rotating platen by pneumatic means at predetermined pressure.

In this invention, improvements are provided so that apparatus for grinding or polishing specimens may operate in automated manner, without the need for pneumatic pressure, using simple electromechanical means for providing a predetermined pressure of grinding or polishing to the specimens. Additionally, the time of operation may be automated to provide automatic shutoff, and the rotation rates of the respective grinding parts may be controlled as well.

DESCRIPTION OF THE INVENTION

In this invention, apparatus is provided for grinding or polishing specimens, comprising a vertical shaft. Means are provided for rotating the vertical shaft, along with means for attaching a holder for specimens to be polished to the lower end of the vertical shaft. Means are also provided for pressing specimens carried in such an attached holder at a predetermined pressure against a polishing surface.

In accordance with this invention, the pressing means comprises a strain gauge. The strain gauge carries the vertical shaft in suspended manner at the upper end of the shaft. As the result of this, the strain gauge may emit a signal response to the sensed weight of the shaft and parts carried thereon. In this circumstance, as the pressure applied to the specimens against a rotating platen increases, the weight sensed by the strain gauge is reduced, or even assumes a negative value.

Additionally, electrically operated mechanical means are provided for vertically advancing and retracting the shaft in a manner responsive to signals from the strain gauge, to provide a feedback system to automatically control the pressure applied to the specimens. It is to be understood that only a portion of the vertical shaft needs to be advanced or retracted, the preferred vertical shaft being a multiple component, expansible and contractible shaft. However, other arrangements may also be used in this invention in which the entire shaft is advanced and retracted, if desired.

Specifically, the vertical shaft may comprise a vertical, threaded rod suspended from the strain gauge. A vertical member is carried by and surrounds at least the lower portion of the threaded rod in telescoping relation thereto. Typically, the vertical member has a sleeve that surrounds at least the lower portion of the threaded rod. The vertical member is rotatable by a first drive motor relative to the threaded rod. Also, the vertical member has a lower end which carries the above-described means for attaching the holder.

A nut member is preferably threadedly attached to the threaded rod, the nut member being also connected to the vertical member by bearing means. An outer portion of the nut member is in a relative rotational relation with the threaded rod so that the outer portion of the nut member can be rotationally fixed as the vertical member rotates, but the entire nut member may be longitudinally slidable with the vertical member along the threaded rod, to which it is threadedly attached.

The preferred shaft of this invention also has means for rotating the threaded rod in a manner which is responsive to signals from the strain gauge. Thus, when the strain gauge records a weight that is lower than desired, indicating that the pressure on the carried specimens against a rotating platen is too high, the threaded rod can be rotated to slightly retract the nut member and vertical member. When the weight recorded by the strain gauge is too heavy, the threaded rod can be rotated to slightly advance the nut member and vertical member to increase the pressure between specimens and a rotating platen, this being accomplished by a continuously monitoring system during the grinding or polishing process to raise or lower the vertical member as needed to maintain desired pressures.

The means for rotating the threaded rod is preferably a conventional gear means which is powered by a direct current motor, for example, a four-quadrant, direct current, fractional horsepower, static-drive motor. On the other hand, the first drive motor that is used to rotate the vertical member at a generally continuous, predetermined rate is preferably an A.C. motor.

Additionally, the preferred apparatus may comprise a frame, with the nut member defining an outer sleeve. One of the frame and outer sleeve defines a vertical slot, while the other of the frame and outer sleeve carries a projection which is slidable in the slot. As the result of this, the nut member moves with the vertical member in longitudinal motion without rotation of the outer sleeve.

Preferably, the threaded rod or its motor carries a peripherally perforated disc. Sensor means are provided for measuring the rotation of the disc by sensing of the moving peripheral perforations. Rotation control means may be provided which are capable of controlling the rotational position of the threaded rod as desired, responsive to signals from the sensor means. Thus, the vertical position of the samples for grinding or polishing may be controlled or monitored by a feedback system for precise control.

DESCRIPTION OF DRAWINGS

FIG. 1 is a perspective view of apparatus for grinding or polishing in accordance with this invention.

FIG. 3 is a schematic flow chart of functions of the apparatus of this invention.

DESCRIPTION OF SPECIFIC EMBODIMENT

Figure 2:
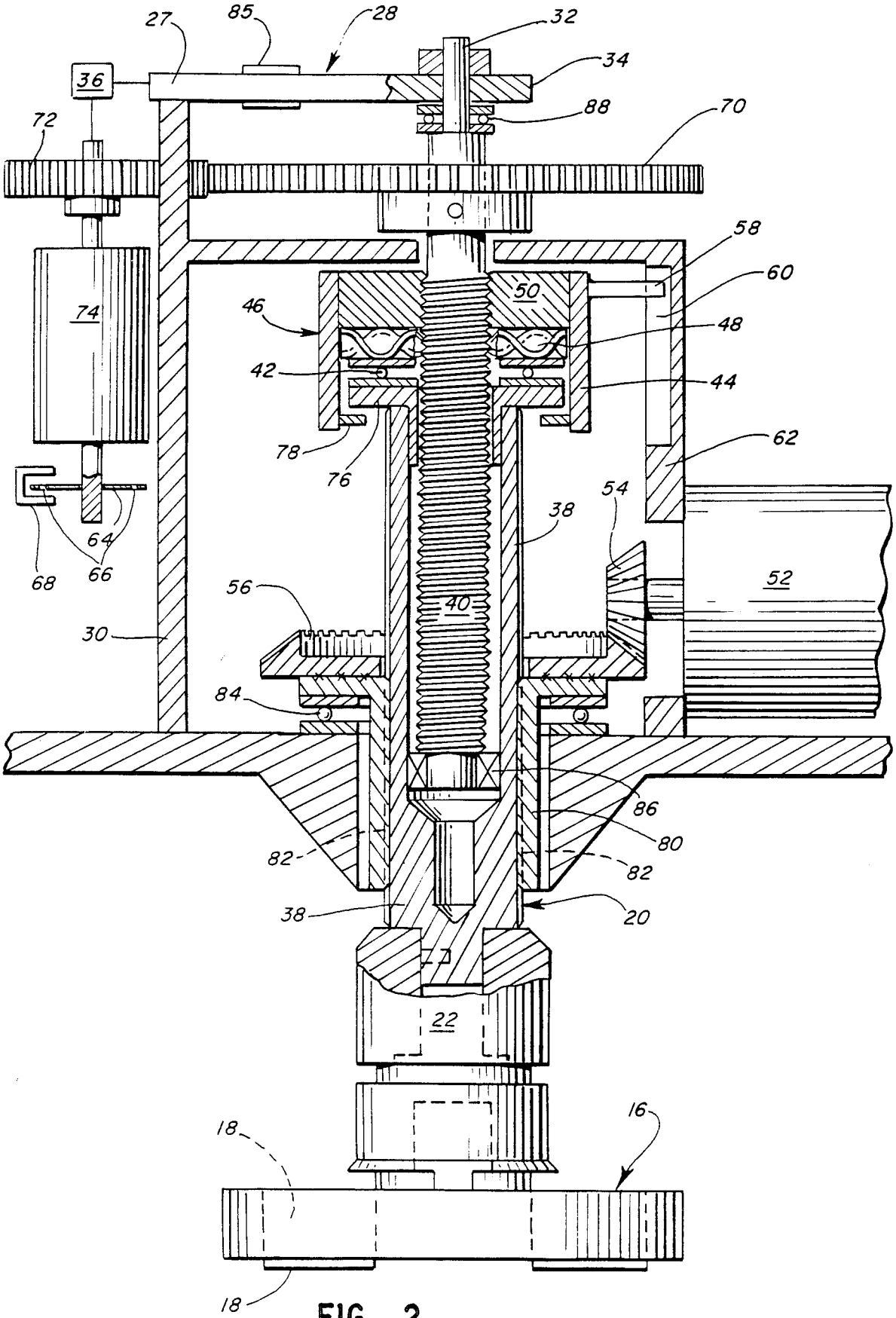
FIG. 2 is a sectional view taken along line 2—2 of FIG. 1.

Referring to the drawings, apparatus 10 for grinding or polishing of specimens is disclosed, being generally similar in construction to the Ecomet IV/Euromet I sample preparation system sold by Buehler Ltd., except for the distinctions described herein.

As in the prior art, a base unit 12 having a rotatable grinding platen 14 is provided, against which a sample holder 16 of conventional design presses a group of samples 18 for grinding or polishing against platen 14. Sample holder 16 is capable of being rotated by shaft 20, in either clockwise or counterclockwise direction, so that, if desired, a complex grinding or polishing pattern may be achieved by the simultaneous rotation of platen 14 and sample holder 16. Abrasive or polishing material is placed upon platen 14 to facilitate the grinding or polishing, and, as is conventional, water or other fluid may be applied to the surface of platen 14 as well to facilitate the grinding or polishing.

Shaft 20 is driven by power head 23, which may be carried on base member 12 by post 24. Power head 23 carries a control panel 26, having appropriate controls and data readout indicators as may be desired.

Shaft 20 carries a removable chuck 22 at its lower end, which, in turn, releasably carries sample holder 16. Chuck 22 may also be of generally conventional design.

In accordance with this invention, a strain gauge 28 of conventional design is carried in a cantilever position from support portion 30 at one end 27 of the strain gauge. The upper end 32 of the shaft 20 is then suspended from strain gauge 28 adjacent its other end 34, so that an electronic readout may be provided by strain gauge 28 of the weight of shaft 20 and related parts as sensed by strain gauge 28 at any given time, shaft 20 being vertically disposed as shown and hanging from the strain gauge. As the result of this, when sample holder 16, which is carried by shaft 20, rests on platen 14, the weight of shaft 20 and sample holder 16 sensed by strain gauge 28 is reduced. The corresponding sensed weight is increased when sample holder 16 is out of contact with platen 14, with the result that the signals from strain gauge 28 to electronic control 36 may be used to compute the total force being exerted on samples 18 against platen 14.

Shaft 20 defines an outer, vertical sleeve member 38, which is positioned in telescoping relation with a lower portion of a vertically disposed threaded rod 40 as shown in FIG. 2. Sleeve member 38 is the portion of shaft 20 that provides the releasable connection with holder 16 at its lower end by chuck 22. Outer sleeve member 38 terminates at its upper end in a thrust bearing 42 which is positioned within outer sleeve 44 of nut means 46, which is provided, among other things, to permit outer sleeve 38 to freely rotate with respect to threaded rod 40. A wave spring washer 48 is positioned above thrust bearing 42 to serve as a shock absorber and cushion to absorb the shock generated when sample holder 16 is lowered into contact with platen 14. Nut 50, positioned within outer sleeve 44, is in threaded relation with threaded rod 40, and is peripherally attached to outer sleeve 44.

A.C. motor 52 defines a bevel gear 54 which engages ring gear 56, the latter gear being attached to outer sleeve member 38. Thus, the operation of motor 52 causes rotation of outer sleeve member 32, as well as chuck 22 and sample holder 16. However, wave spring 48 and nut 50 do not rotate by the action of motor 52, being separated from the rotating sleeve 38 by thrust bearing 42.

Outer sleeve 44 carries a projecting pin 58 that fits into slot 60 of frame member 62 of the apparatus. Thus, outer sleeve 44 and nut 50 are prevented from rotation.

Threaded rod 40 carries a gear 70, which meshes with gear 72 which, in turn, is driven by four quadrant, direct current, fractional horsepower, static drive motor 74. Motor 74 can be used to control the vertical position of the upwardly and downwardly movable portions of shaft 20, as well as holder 16. Motor 74 is also used to apply the desired pressure between platen 14 and samples 18 in holder 16. As motor 74 rotates gear 72, threaded rod 40 is correspondingly rotated. Nut 50 and outer sleeve 44 are incapable of rotation due to the restraining action of pin 58 and vertical slot 60. Accordingly, the rotation of shaft 40 drives nut 50 upwardly or downwardly. This, correspondingly, forces thrust bearing 42, sleeve 38, and the other carried parts upwardly or downwardly, flange 76 at the upper end of outer sleeve 38 being captured within nut member 46 by inwardly projecting flange 78.

The lower portion of outer sleeve 38 is a spline shaft which is rotationally fixed with respect to ring gear 56. Ring gear 56 is attached to sleeve member 80, which, in turn, is attached to outer sleeve 38 by means of sliding key and keyway arrangements 82. Thus, sleeve 38 slides with respect to sleeve 80 and ring gear 56, as nut 50 is driven upwardly and downwardly by the rotation of threaded rod 40. The rotating ring gear 56 is supported and held in position by bearing 84.

Other bearings 86, 88 support the opposed ends of threaded rod 40 to facilitate its rotation.

As the result of this, motor 52 is capable of freely rotating outer sleeve 38, and any attached sample holder 16, without rotation of threaded rod 40. When it is desired to raise to lower sample holder 16, or to increase or decrease pressure of samples 18 against platen 14, motor 74 rotates the respective connected gears 72, 70, to rotate threaded rod 40. This, in turn, imparts vertical motion to nut 50 which forces outer shaft 38 and sample 18 into corresponding vertical motion in a manner which is independent of the rate of rotation of outer sleeve 38. The force between samples 18 and platen 14 may be derived from respective electronic readings from strain gauge 28, which readings may be processed by electronic control 36 to control motor 74 to keep such force weight at a desired level.

If desired, disc 64 may be also carried by the output of motor 74. Peripheral perforations 66 may be provided to disc 64, so that optical sensor 68, of conventional design, may count perforations passing through it as motor 74 operates. By this means, a direct sensing of the rotational position of threaded rod 40 and thus the vertical position of chuck 22 may be provided to electronic control system 38 of head 23.

Referring to FIG. 3, a functioning flow chart of head 23 is disclosed. The electronics required to perform said functions are generally conventional and well within the routine designing skill of an electrical engineer.

As shown, electronic control 36 can receive inputs from manual controls on control panel 26 to set the time of operation, the desired pressure to be exerted between samples 18 and platen 14, and instructions to start or stop operation. Electronic control 36 also receives continuing inputs from load cell 85 of strain gauge 28. Electronic control 36 correspondingly operates DC motor 74 in response to these instructions to advance samples 18 into contact with platen 14 and to set the desired load. Then, electronic control-36 instructs electronic control 94 to start operation of AC motor 52. The direction of rotation of shaft 20 and holder 16 may be set by control 90, while the rotation rate may be set by control 92. Feedback from sensor 68 may also be provided to electronic control 94 for rotation speed control.

Accordingly, by the interaction of motors 52 and 74, the desired grinding and polishing process takes place, with feedback being provided for motor operation through load cell 84, and also optional optical sensor 68.

Accordingly, power head 22 of this invention may operate substantially automatically, and without the need for a source of pressurized air. A strain gauge is used in a substractive manner, so that the sensed reduction of weight caused by application of pressure between the samples and platen may be measured, and such pressure may be automatically adjusted to desired values by the feedback system utilized in this invention. Additionally, if desired, the speed of rotation may be similarly monitored, and controlled through a feedback mechanism. Thus, improved polishing and grinding is provided with less attention being required by the operator of the apparatus during the polishing or grinding process.

The above has been offered for illustrative purposes only, and is not intended to limit the scope of the invention of this application, which is as defined in the claims below.

That which is claimed is:

1. In apparatus for grinding or polishing specimens comprising a vertical shaft; means for rotating said vertical shaft; means for attaching a holder for specimens to be polished to the lower end of the vertical shaft; and means for pressing specimens carried in such an attached holder at a predetermined force against a polishing surface, the improvement comprising, in combination:

said pressing means comprising a strain gauge, said strain gauge carrying said vertical shaft at the upper end of the shaft whereby the strain gauge may emit a signal responsive to the sensed weight of the shaft and parts carried thereon; and electrically operated mechanical means for vertically advancing and retracting said shaft in a manner responsive to signals from said strain gauge during the grinding or polishing process.

2. The apparatus of claim 1 in which said vertical shaft comprises a vertical threaded rod suspended from said strain gauge; a vertical member carried by and surrounding at least a lower portion of said threaded rod in telescoping relation thereto, said vertical member being rotatable by a first drive motor relative to said threaded rod and having a lower end which carries said means for attaching a holder; and a nut member threadedly attached to said threaded rod and rotatably connected to said vertical member, with an outer portion of the nut member being in relative rotational relation with said threaded rod, said outer portion of said nut member being rotationally fixed but longitudinally slidable; said apparatus also having means for rotating said threaded rod in a manner responsive to signals from said strain gauge to raise or lower said vertical member in longitudinal motion.

3. The apparatus of claim 2 in which said vertical member is a sleeve that surrounds at least the lower portion of said threaded rod.

4. The apparatus of claim 2 in which said means for rotating the threaded rod is powered by a four quadrant, direct current, fractional horsepower static drive motor.

5. The apparatus of claim 2 in which said first drive motor is an A.C. motor.

6. The apparatus of claim 2 which defines a frame, said nut member defining an outer sleeve, one of said frame and outer sleeve defining a vertical slot, and the other of said frame and outer sleeve carries a projection slidable in said slot, whereby said nut member moves with said vertical member in longitudinal motion without rotation of the outer sleeve.

7. The apparatus of claim 2 in which said rotating means carries a peripherally perforated disk; sensor means for measuring the rotation of said disk by sensing of the moving peripheral perforations; and rotation control means capable of controlling the rate of rotation of said threaded rod responsive to signals from said sensor means.

8. An apparatus for grinding or polishing specimens comprising a vertical shaft; means for rotating said vertical shaft; means for attaching a holder for specimens to be polished to the lower end of the vertical shaft; and means for pressing specimens carried in such an attached holder at a predetermined force against a polishing surface, the improvement comprising, in combination:

said pressing means comprising a strain gauge, said strain gauge carrying said vertical shaft at the upper end of the shaft whereby the strain gauge may emit a signal response to the sensed weight of the shaft and parts carried thereon; electrically operated mechanical means for vertically advancing and retracting said shaft in a manner responsive to signals from the strain gauge during the grinding process, said electrically operated mechanical means comprising a vertical, threaded rod as part of said vertical shaft suspended from the strain gauge; a vertical member part of the vertical shaft carried by and surrounding at least a lower portion of the threaded rod in telescoping relation thereto, said vertical member being rotatable by a first drive motor relative to said threaded rod and having a lower end which carries said means for attaching a holder; and a nut member threadedly attached to said threaded rod and rotatably connected to said vertical member with an outer portion of the nut member being in relative rotational relation with said threaded rod, said outer portion of the nut member being rotationally fixed and longitudinally slidable; said shaft means also having means for rotating said threaded rod in a manner responsive to signals from said strain gauge to raise or lower said vertical member in longitudinal motion, said means for rotating the threaded rod being powered by a four quadrant, direct current, fractional horsepower, static drive motor; said apparatus defining a frame, said nut member defining an outer sleeve, one of said frame and outer sleeve defining a vertical slot, the other of said frame and outer sleeve carrying a projection slidable in said slot, whereby said nut member moves with said vertical member in longitudinal motion without rotation of the outer sleeve.

9. The apparatus of claim 8 in which said vertical member is a sleeve that surrounds at least the lower portion of said threaded rod.

10. The apparatus of claim 9 in which said first drive motor is an AC motor.

11. The apparatus of claim 9 in which said static drive motor carries a peripherally perforated disc; sensor means for measuring rotation of said disc by sensing of the moving peripheral perforations; and rotation control means being capable of controlling the rate of rotation of said threaded rod responsive to signals from said sensor means.

12. An apparatus for grinding or polishing specimens comprising a vertical shaft; means for rotating said vertical shaft; means for attaching a holder for specimens to be polished to the lower end of the vertical shaft; and means for pressing specimens carried in such an attached holder at a predetermined force against said polishing surface, the improvement comprising, in combination:

said vertical shaft comprising a vertical threaded rod; a vertical member carried by and surrounding at least a lower portion of said threaded rod in telescoping relation thereto, said vertical member being rotatable by a first drive motor relative to said threaded rod, and having a lower end which carries said means for attaching a holder; and a nut member threadedly attached to said threaded rod and rotatably connected to said vertical member with an outer portion of said nut member being in relative rotational relation with said threaded rod, said outer portion of said nut member being rotationally fixed but longitudinally slidable; said apparatus also having means for rotating said threaded rod, to raise or lower said vertical member in longitudinal motion.

13. The apparatus of claim 12 in which said vertical member is a sleeve that surrounds at least the lower portion of said threaded rod.

14. The apparatus of claim 12 in which said means for rotating the threaded rod is powered by a four quadrant, direct current, fractional horsepower static drive motor.

15. The apparatus of claim 12 in which said first drive motor is an A.C. motor.

16. The apparatus of claim 12 which defines a frame, said nut member defining an outer sleeve, one of said frame and outer sleeve defining a vertical slot, the other of said frame and outer sleeve carrying a projection slidable in said slot, whereby said nut member moves with said vertical member in longitudinal motion without rotation of the outer sleeve.

17. The apparatus of claim 12 in which said static drive motor carries a peripherally perforated disk; sensor means for measuring the rotation of said disk by sensing of the moving peripheral perforations; and rotation control means being capable of controlling the rate of rotation of said threaded rod responsive to signals from said sensor means.

18. In apparatus for grinding or polishing specimens comprising a vertical shaft; means for rotating said vertical shaft; means for attaching a holder for specimens to be polished to the lower end of the vertical shaft; and means for pressing specimens carried in such an attached holder at a predetermined force against a polishing surface, the improvement comprising, in combination:

said pressing means comprising a strain gauge, said strain gauge carrying said vertical shaft at the upper end of the shaft whereby the strain gauge may emit a signal responsive to the sensed weight of the shaft and parts carried thereon; and electrically operated mechanical means for vertically advancing and retracting said shaft in a manner responsive to signals from said strain gauge during the grinding process, said shaft including a vertical rod, and a vertical member which is relatively rotatable with respect to said vertical rod, said vertical member being in telescoping relation with said vertical rod; means for rotating said vertical member; means for causing said vertical rod and vertical member to increase or decrease its overall length as said vertical rod is rotated relative to said apparatus, said electrically operated mechanical means being adapted to rotate said vertical rod to vertically advance or retract said shaft in response to signals from said strain gauge by increasing or decreasing said overall length.

19. The apparatus of claim 18 including a frame, and in which said vertical rod comprises a threaded rod suspended from said strain gauge; said vertical member being carried by and surrounding at least a lower portion of said threaded rod in telescoping relation thereto, said vertical member being rotatable by a first drive motor relative to said threaded rod and having a lower end which carries said means for attaching a holder; and a nut member having an inner portion threadedly attached to said threaded rod and rotatably connected to said vertical member to permit free rotation thereof, with an outer portion of said nut member being rotatable relative to said threaded rod, said outer portion of nut member being rotationally fixed to, but longitudinally slidable with, said frame.

20. The apparatus of claim 19 in which the outer portion of said nut member defines an outer sleeve, one of said frame and outer sleeve defining a vertical slot, and the other of said frame and outer sleeve carrying a projection slidable in said slot, whereby said nut member moves with said vertical member in longitudinal motion without rotation of the outer sleeve.

21. The apparatus of claim 18 in which said vertical rod rotating means carries a disk having peripheral indicator means; sensor means for measuring the rotation of said disk by sensing the rotation of the indicator means; and rotation control means capable of controlling the rate of rotation of said threaded rod responsive to signals from said sensor means.

* * * * *